US009134658B2

(12) United States Patent
Matsuura

(10) Patent No.: US 9,134,658 B2
(45) Date of Patent: Sep. 15, 2015

(54) IMAGE FORMING APPARATUS CONTROLLING VOLTAGE OF TRANSFER MEMBER

(71) Applicant: CANON KABUSHIKI KAISHA, Tokyo (JP)

(72) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/167,354

(22) Filed: Jan. 29, 2014

(65) Prior Publication Data

US 2014/0219671 A1 Aug. 7, 2014

(30) Foreign Application Priority Data

Feb. 5, 2013 (JP) ..... 2013-020442

(51) Int. Cl.
*G03G 15/16* (2006.01)

(52) U.S. Cl.
CPC ..... *G03G 15/1675* (2013.01)

(58) Field of Classification Search
CPC ..... G03G 15/1675
USPC ..... 399/50, 66
See application file for complete search history.

(56) References Cited

U.S. PATENT DOCUMENTS 5,151,736 A * 9/1992 Ohzeki et al. ..... 399/66
5,471,283 A * 11/1995 Irihara et al. ..... 399/18
5,646,717 A * 7/1997 Hiroshima et al. ..... 399/154
5,701,551 A * 12/1997 Honda et al. ..... 399/50
6,021,287 A * 2/2000 Tanaka ..... 399/66
6,735,402 B2 5/2004 Oki
7,106,984 B2 * 9/2006 Katsumi ..... 399/66
7,146,123 B2 * 12/2006 Kidaka ..... 399/129
7,266,318 B2 * 9/2007 Inukai ..... 399/66
8,577,237 B2 * 11/2013 Aoki ..... 399/66
8,718,501 B2 * 5/2014 Aoki ..... 399/66
2003/0081959 A1 * 5/2003 Komori ..... 399/50
2003/0091358 A1 * 5/2003 Komori ..... 399/50
2004/0218939 A1 * 11/2004 Motohashi et al. ..... 399/50
2005/0175374 A1 * 8/2005 Kosuge ..... 399/168
2006/0171730 A1 * 8/2006 Kitajima ..... 399/66
2006/0198650 A1 * 9/2006 Nakaso ..... 399/66
2006/0222389 A1 * 10/2006 Kin et al. ..... 399/49

(Continued)

FOREIGN PATENT DOCUMENTS

JP 02-123385 A 5/1990
JP 05-181373 A 7/1993

(Continued)

*Primary Examiner* — David Bolduc
(74) *Attorney, Agent, or Firm* — Fitzpatrick, Cella, Harper & Scinto

(57) ABSTRACT

An image forming apparatus includes a controller executing a setting mode for setting a voltage to be applied to an image transfer member when a toner image is transferred onto a transfer medium, so that a predetermined current flows through a charging member when such an area of an image bearing drum as has carried the toner image transferred onto a transfer medium at a transfer portion then passes through a charge portion, the setting being executed on the basis of a current detected by a first detecting member when such a region of the drum as has been charged by the charging member and has been passed through the transfer portion in a state that a test voltage is applied to the transfer member then passes through the charge portion in a period in which no toner image passes through the transfer portion.

8 Claims, 11 Drawing Sheets

(56) References Cited

U.S. PATENT DOCUMENTS

| | | | | |
|---|---|---|---|---|
| 2008/0095550 | A1* | 4/2008 | Naito et al. | 399/50 |
| 2008/0159765 | A1* | 7/2008 | Shigezaki et al. | 399/71 |
| 2009/0010667 | A1* | 1/2009 | Mabuchi et al. | 399/66 |
| 2009/0028591 | A1* | 1/2009 | Kubo | 399/50 |
| 2009/0080924 | A1* | 3/2009 | Kojima | 399/66 |
| 2009/0196638 | A1* | 8/2009 | Sukesako et al. | 399/45 |
| 2009/0226198 | A1* | 9/2009 | Sugiyama | 399/66 |
| 2010/0061750 | A1* | 3/2010 | Okada | 399/55 |
| 2010/0189457 | A1* | 7/2010 | Inukai | 399/66 |
| 2011/0110677 | A1* | 5/2011 | Uehara | 399/50 |
| 2011/0293306 | A1* | 12/2011 | Matsumoto | 399/66 |
| 2012/0003016 | A1* | 1/2012 | Uchiyama et al. | 399/301 |
| 2012/0183310 | A1* | 7/2012 | Asano et al. | 399/26 |
| 2013/0004191 | A1* | 1/2013 | Hayami | 399/66 |
| 2013/0259502 | A1* | 10/2013 | Motomura | 399/50 |

FOREIGN PATENT DOCUMENTS

| | | | | |
|---|---|---|---|---|
| JP | 5-307287 | B1 | | 11/1993 |
| JP | 2002-341678 | A | | 11/2002 |
| JP | 2003-076101 | A | | 3/2003 |
| JP | 2003-302808 | A | | 10/2003 |
| JP | 2006171323 | A | * | 6/2006 |
| JP | 2008111953 | A | * | 5/2008 |

* cited by examiner (a)

(b)

REQUIRED TRANS. CUR. TABLE

| R. H. | | 5% | 20% | 35% | 50% | 65% | 80% | 95% |
|---|---|---|---|---|---|---|---|---|
| CUR. μA | CRG INITIAL | 40 | 37 | 34 | 32 | 30 | 27 | 25 |
| | CRG AFTER LONG USE | 34 | 30 | 28 | 26 | 22 | 18 | 15 |

Fig. 5

IMAGE FORMING APPARATUS CONTROLLING VOLTAGE OF TRANSFER MEMBER

FIELD OF THE INVENTION AND RELATED ART

The present invention relates to an image forming apparatus for forming an image by an electrophotographic type process.

The following techniques, for example, are put into practice as low cost techniques in the field of an image forming apparatus such as an electrophotographic type or electrostatic recording type apparatus:

(1) DC charging type; and (2) pre-exposureless type.

These techniques will be described.

(1) DC charging type:

As charging means for charging an image bearing member which is an electrophotographic photosensitive member, a contact charging type charging device for charging a charged member (member to be charged) such as an image bearing member by contacting electroconductive charging means supplied with a voltage to the charged member has been put into practice. Particularly, a roller charging type contact charging device using an electroconductive elastic roller (charging roller) as charging means and press-contacting it to the charged member is preferably used from the standpoint of charging stabilization. More specifically, the charging is carried out by electric discharge from the charging roller to the charged member, and a voltage higher than a threshold voltage is applied to start the electric discharge.

In the roller charging type, a so-called AC/DC charging type is used wherein the charging roller is supplied with a voltage in the form of a DC voltage corresponding to a desired surface potential Vd of the charged member plus an AC voltage component having a peak-to-peak voltage not less than twice the charging start threshold voltage (Vth). With such an AC/DC charging type, by the potential smoothing effect of the AC voltage component, the potential of the charged member is converged to the potential Vd which is the center of the peaks of the AC voltage, and therefore, the charging is not influenced by the external conditions such as ambient conditions.

However, since the AC/DC charging type requires an AC voltage source in addition to a DC voltage source to add a high AC voltage component (twice the charging start threshold voltage in the DC voltage application, the cost of the device per se may increase. For this reason, recently, a so-called DC charging type applying only a DC voltage to the charging roller is often employed.

(2) Pre-exposureless type:

A type using pre-exposureless means for removing residual charge from the surface of the electrophotographic photosensitive member (photosensitive member) after image transfer by a LED chip array, a fuse lamp, a halogen lamp or a fluorescent lamp provided upstream of the charging process station is known. However, with such a type, a disposing space for the pre-exposureless means is required, and a latitude of dispositions of various devices around the photosensitive drum as the photosensitive member is narrowed.

In addition, the pre-exposureless device as the pre-exposureless means and the discharging device require a voltage source and/or mounting structures exclusive therefor with the result of increase of the number of parts, thus making the downsizing and cost-decreasing difficult. For this reason, the devices employing a so-called pre-exposureless type not using the pre-exposureless means is more widely used in order to meet the demand for the downsizing and low cost.

Japanese Laid-open Patent Application 2003-302808 proposes a simple structure image forming apparatus of the pre-exposureless type not using the charging type (1) or the pre-exposureless device (2).

On the other hand, in a device in which the toner image is transferred onto the recording material while a constant voltage is applied to the transfer portion, an ATVC control system or a PTVC control system is used in which a voltage is applied to the transfer portion prior to the image formation, and the current through the transfer portion is measured, on the basis of which a voltage condition to be used in the transfer portion during the image formation is set. The ATVC control system and the PTVC control system will be described.

[ATVC Control System]

In Japanese Laid-open Patent Application Hei 2-123385, a constant current corresponding to a current required for transfer of the toner image during image formation is applied to the transfer portion through which no toner image passes, and an output voltage value is measured. On the basis of the result of the measurement, a voltage applied to the transfer roller during the image formation is set (ATVC (Active Transfer Voltage Control) system).

[PTVC Control System]

In Japanese Laid-open Patent Application Hei 5-181373, a plurality of constant voltages are applied to the transfer portion through which no recording material passes, and the currents through the transfer roller are measured. From the plurality of voltage—current data, an output voltage corresponding to the current required for the transfer of the toner image during the image formation is interpolated, on the basis of which the constant voltage to be used during the image formation is set. The current required for the transfer of the toner image as the target transferring current used during the image formation is set in accordance with a transferring current value table pre-set corresponding to toner charge amounts which are different depending on the temperature and humidity under lower ambient condition in which the apparatus is placed.

On the other hand, with the apparatus using the DC charging type and/or the pre-exposureless type, so-called "positive ghost image" tends to appear. The positive ghost image is a phenomenon in which a slightly amount of toner is deposited on the white background portion to become visual. The device of the DC charging type and the pre-exposureless type is disadvantageous from the standpoint of the positive ghost image.

[The Reasons why the DC Charging Type is Disadvantageous From the Standpoint of Positive Ghost Image]

With the AC/DC charging type, when the surface of the photosensitive drum having a potential non-uniformity is recharged, the convergence property of the charged potential is better than with the DC charging type, because of the potential smoothing effect of the AC voltage as described above, and therefore, the positive ghost image does not tend to occur. However, the DC charging type does not have the potential smoothing effect, and therefore, is disadvantageous as compared with the AC/DC charging type from the standpoint of the positive ghost image.

[Reasons why Pre-Exposureless Type is Disadvantageous from the Standpoint of Positive Ghost Image]

The pre-exposureless device is a LED chip array, a fuse lamp, a halogen lamp, or a fluorescent lamp or the like for removing by light the potential of the photosensitive drum before the charging after image transfer. When the photosensitive drum surface potential is uneven, the potential of the surface of the photosensitive drum can be uniformly canceled, but the pre-exposureless type not using the pre-exposureless device is disadvantageous from the standpoint of the positive ghost image.

SUMMARY OF THE INVENTION

According to an aspect of the present invention, there is provided an image forming apparatus comprising a movable image bearing member; a charging member for charging said image bearing member at a charge portion; a first detecting member for detecting a current flowing through said charging member; a toner image forming unit for forming a toner image on said image bearing member; a transfer member for transferring, at a transfer portion, a toner image formed on said image bearing member onto a transfer medium; a transferring voltage source for applying a voltage to said transfer member; a second detecting member for detecting a current flowing through said transfer member; and a controller capable of executing a setting mode for setting a voltage to be applied to said transfer member at the time when the toner image is transferred onto the transfer medium, so that a predetermined current flows through said charging member when such an area of said image bearing member as has carried the toner image transferred onto the transfer medium at the transfer portion then passes through said charge portion, the setting being executed on the basis of a current detected by said first detecting member when such a region of said image bearing member as has been charged by said charging member and has been passed through said transfer portion in a state that a test voltage is applied to said transfer member then passes through said charge portion in a period in which no toner image passes through said transfer portion.

Further features of the present invention will become apparent from the following description of exemplary embodiments with reference to the attached drawings.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5 is a required transferring current table according to first and second embodiments of the present invention.

DESCRIPTION OF THE EMBODIMENTS

<First Embodiment>

Figure 1:
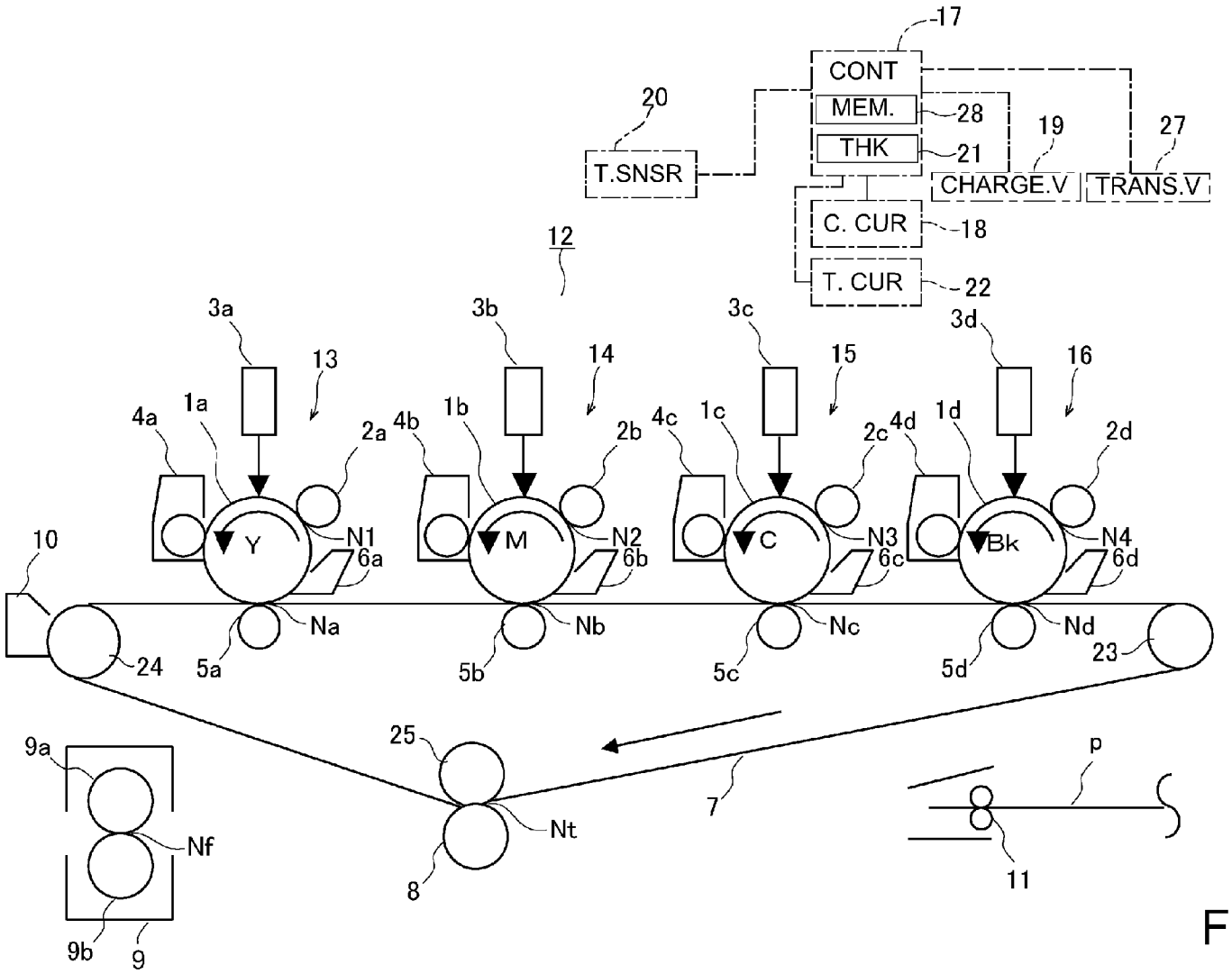
FIG. 1 is a schematic view schematically illustrating an image forming apparatus according to an embodiment of the present invention.

First Embodiment according to the present invention will be described with reference to the drawings. FIG. 1 is a schematic view showing an example of an image forming apparatus 12 according to this embodiment of the present invention.

The image forming apparatus 12 includes, as shown in FIG. 1, image forming portions 13, 14, 15 and 16 as four stations arranged in a line at certain intervals. The image forming portion 13 forms an image (toner image) of yellow (Y), the image forming portion 14 forms an image (toner image) of magenta (M), the image forming portion 15 forms an image (toner image) of cyan (C), and the image forming portion 16 forms an image (toner image) of black (Bk).

The image forming apparatus 12 includes, as a charging high-voltage source, only a charging power source (DC voltage circuit) 19 and employs a DC charging type in which a surface of each of photosensitive drums 1*a*, 1*b*, 1*c* and 1*d* is electrically charged by a DC voltage. That is, in this embodiment, primary transfer rollers 5*a*-5*d* as a charging means electrically charge the surfaces of the photosensitive drums 1*a*-1*d* as an image bearing member at charging nips N1-N4 as a charging portion by applying a charging bias using only a DC component from the charging power source 19 to each of the primary transfer rollers 5*a*-5*d*. For this reason, there is no need to provide an AC voltage source separately from the DC power source, different from the case of an AC/DC charging type, and therefore a device structure can be simplified to obviate an increase in cost. This is similar to that in Second Embodiment described later.

Further, the image forming apparatus 12 employs a pre-exposure-less type in which a pre-exposure means for light-removing a residual electric charge on the surface of each of the photosensitive drums 1*a*-1*d* after the toner image transfer is not provided upstream of a charging process means in order to reduce a cost. For this reason, there is no need to provide a pre-exposure device or a charge-removing device as the pre-exposure means, and there is also no need to provide a dedicated power source and a mounting structure. Therefore, the number of parts is reduced, so that it is possible to obtain an effect such that the image forming apparatus 12 can be decreased in size and cost.

The image forming portions 13-16 include the photosensitive drums 1*a*-1*d*, respectively, as the image bearing member (photosensitive member) for bearing the toner image. At peripheries of the photosensitive drums 1*a*-1*d*, members including charging rollers 2*a*-2*d*, exposure devices 3*a*-3*d*, developing devices 4*a*-4*d*, the primary transfer rollers 5*a*-5*d* and the drum cleaning device 6a-6d are provided, respectively. In the developing devices 4a-4d, a yellow toner, a magenta toner, a cyan toner and a black toner are accommodated, respectively.

The image forming portions 13-16 are constituted as process cartridges (CRGs) for the respective colors in which the photosensitive drums 1a-1d, the charging rollers 2a-2d, the exposure devices 3a-3d, the developing devices 4a-4d and the drum cleaning devices 6a-6d are integrally assembled.

In the following, in the case where the photosensitive drums 1a-1d, the charging rollers 2a-2d, the exposure devices 3a-3d, the developing devices 4a-4d, the primary transfer rollers 5a-5d and the drum cleaning devices 6a-6d are collectively described without being distinguished, these members or devices will be described as the photosensitive drum 1, the charging roller 2, the exposure device 3, the developing device 4, the primary transfer roller 5 and the drum cleaning device 6, respectively.

In a full-color image forming method on a recording material by the image forming apparatus 12, color toner images based on electrostatic latent images (latent images) formed on the respective photosensitive drums 1a-1d by the exposure devices 3a-3d are successively transferred supposedly onto an intermediary transfer belt 7 by the primary transfer rollers 5a-5d, respectively. Then, the toner images transferred onto the intermediary transfer belt 7 are secondary-transferred, by using a secondary transfer roller 8, onto a recording material P fed by a sheet feeding roller 11 to the secondary transfer roller 8.

The intermediary transfer belt 7 is an endless belt and is stretched and supported by supporting rollers 23, 24 and 25 at an inner surface thereof. Of the supporting rollers 23, 24 and 25, e.g., the supporting roller 23 is constituted as a driving roller, and the supporting rollers 24 and 25 are constituted as follower rollers. The secondary transfer roller 8 is contacted to the intermediary transfer belt 7 toward the supporting roller 25, so that a secondary transfer nip Nt is formed between the secondary transfer roller 8 and the intermediary transfer belt 7.

Then, the recording material P separated from the secondary transfer roller 8 is pressed and heated at a fixing nip Nf between a fixing roller 9a and a pressing roller 9b of a fixing device 9, so that a full-color toner image is fixed on the recording material P. After the fixing, this recording material P is discharged to an outside of the image forming apparatus. The toner which has not completely been transferred at the above-described secondary transfer nip Nt is removed by a belt cleaning device 10.

Inside a main assembly (not shown) of the image forming apparatus 12, a controller (contact portion) 17, a charging current detecting portion 18, a transfer current detecting portion 22, a charging power source 19, a transfer power source 27 and a temperature and humidity sensor 20 for detecting a temperature and a humidity are provided. The controller 17 includes a memory 28 and a thickness calculating portion 21. Each of the charging current detecting portion 18, the transfer current detecting portion 22, the charging power source 19, the transfer power source 27 and the temperature and humidity sensor 20 is connected with the controller 17.

The charging rollers 2a-2d constitute charging means for electrically charging the surfaces of the photosensitive drums 1a-1d at charging nips (charging portions) N1-N4 by applying charging biases to the photosensitive drums 1a-1d as the image bearing member.

The charging current detecting portion 18 constitutes a charging current detecting means for detecting a charging current flowing when the charging biases are applied to the photosensitive drums 1a-1d by the charging rollers 2a-2d.

The primary transfer rollers 5a-5d constitute transfer means for transferring the toner images, carried on the photosensitive drums 1a-1d (image bearing members), onto the intermediary transfer belt 7 as a transfer-receiving member at transfer nips (transfer portions) Na, Nb, Nc and Nd.

The transfer power source 27 portion is constituted by a DC voltage circuit and applies a DC transfer bias to the primary transfer rollers 5a-5d as a transfer means. From the transfer power source 27 to the primary transfer rollers 5a-5d, as a transfer voltage, a transfer voltage (transfer bias) of an opposite polarity (e.g., a positive polarity) to a normal charge polarity (e.g., a negative polarity) of the toner is applied.

The transfer current detecting portion 22 constitutes a transfer current detecting means and detects a transfer current flowing when the transfer bias is applied to the intermediary transfer belt (transfer-receiving member) by the primary transfer rollers 5a-5d.

The temperature and humidity sensor 20 is provided in the main assembly (not shown) of the image forming apparatus 12 and constitutes a humidity detecting means for detecting a humidity of the image forming apparatus 12 in a disposition environment.

The thickness calculating portion 21 constitutes a film (layer) thickness calculating means for calculating a film thickness of a charge transporting layer (CT layer) of each of the photosensitive drums 1a-1d on the basis of a driving time of each of the photosensitive drums 1a-1d in a charged state.

The charging rollers 2a-2d as a charging means electrically charge the surfaces of the photosensitive drums 1a-1d uniformly to a predetermined potential by a charging bias applied as a charging high voltage from the charging power source 19. As the charging bias applied at this time, a voltage of an output value based on a value depending on a toner image developing property is applied from the charging power source 19 by control of the controller 17 on the basis of detection of the temperature and humidity sensor 20.

The transfer current detecting portion 22 detects the transfer current flowing when the transfer bias is applied to the primary transfer rollers (transfer means) 5a-5d. Further, the transfer current detecting means 22 detects transfer currents flowing when transfer biases of a plurality of different levels are applied to the primary transfer rollers (transfer means) 5a-5d in order to electrostatically transfer the toner images from the photosensitive drums 1a-1d onto the intermediary transfer belt 7.

In this embodiment, as each of the photosensitive drums 1a-1d, a negatively chargeable organic photoconductor (OPC) member of, e.g., 30 mm in outer diameter is used and is rotationally driven in an arrow direction (counterclockwise direction in FIG. 1) ordinarily at a process speed (peripheral speed) of 200 mm/sec by drive of a driving device (not shown). Each of the photosensitive drums 1a-1d is prepared by applying charge transporting layer (CT layer) 26 (FIG. 2) onto the surface of an aluminum cylinder (electroconductive drum support). The thickness of the charge transporting layer (CT layer) 26 is set at, e.g., 18 μm in this embodiment, and when the CT layer 26 is abraded to 13 μm in thickness, there is a possibility that a problem such as improper charging occurs. Incidentally, the CT layer 26 is shown on only the photosensitive drum 1b in FIG. 2 but is similarly provided on also other photosensitive drums 1a, 1c and 1d.

An amount of abrasion of the photosensitive drum 1 by repetition of image formation (durability) varies depending on a charging type, and is about 1 μm/10,000 sheets in a DC charging type and is about 3 μm/10,000 sheets in an AC/DC charging type. Compared with the AC/DC charging type in which a discharge current is large, the DC charging type in which the abrasion amount of the photosensitive drum 1 is small is advantageous in terms of extension of a lifetime of the photosensitive drum 1.

The abrasion amount of the CT layer 26 is proportional to a driving time of the drum (photosensitive member) 1 rotated in the charged state. For that reason, the thickness calculating portion 21 as a film thickness calculating means calculates the film thickness of the CT layer 26 of each of the photosensitive drums 1*a*-1*d* on the basis of the driving time of each of the photosensitive drums 1*a*-1*d* in the charged state. That is, the thickness calculating portion 21 calculates (detects) the thickness of the CT layer 26 by calculating the driving time of the photosensitive drum 1 in the charged state.

A charging current amount (preliminarily set charging current) necessary to prevent an occurrence of a positive ghost image varies depending on the thickness of the CT layer 26. For that reason, the controller 17 executes a transfer bias setting sequence to set a transfer bias corresponding to the preliminarily set charging current, so that a necessary charging current value is obtained. Based on this, the controller 17 controls bias values of the charging, the development and the like.

Each of the charging rollers 2*a*-2*d* is, e.g., 320 mm in length with respect to a longitudinal direction (axial direction) and has a three-layer structure, on a stainless steel core metal of 6 mm in diameter, consisting of a lower layer, an intermediate layer and a surface layer in lamination. The lower layer is a foamed sponge layer of carbon-dispersed EPDM and is 102-109 Ω in volume resistance value and 3.0 μ in layer thickness.

The intermediate layer is formed with carbon-dispersed NBR rubber and is 102-105 Ω in volume resistance value and 700 μm in layer thickness. The surface layer is constituted by dispersing tin oxide and carbon black in a resin material of a fluorine-containing compound and is a protective layer of 107-1010 Ω in volume resistance value. A volume resistance value of a whole of the charging rollers 2*a*-2*d* is 105 Ω.

The charging rollers 2*a*-2*d* are urged toward centers of the corresponding photosensitive drums 1*a*-1*d*, respectively, to be press-contacted to the surfaces of the photosensitive drums 1*a*-1*d*, respectively, at a predetermined urging force, and are rotated by rotational drive of the photosensitive drums 1*a*-1*d*, respectively.

Each of the primary transfer rollers 5*a*-5*d* is, e.g., 320 mm in length with respect to the longitudinal direction (axial direction) and is prepared by providing a foamed sponge of NBR on a stainless steel core metal of 8 mm in diameter, and is constituted as a roller of, e.g., $5\times10^5$–$1\times10^6$ Ω in volume resistance value and, e.g., 16 mm in diameter.

[Position ghost]

In the image forming apparatus using the technique of the DC charging type and the pre-exposure-less type, the device structure is simplified by omitting the AC power source and the pre-exposure device and thus is advantageous in terms of a low cost but the positive ghost image is liable to generate. This was described above. Here, the positive ghost image will be described again.

The image forming apparatus 12 including the intermediary transfer belt 7 employs an image forming process of a reversal development type using a negative toner. In the image forming apparatus 12, the toner images formed by the development on the photosensitive drums 1*a*-1*d* corresponding to the respective colors are successively superposed on the intermediary transfer belt 7 by the primary transfer using the primary transfer rollers 5*a*-5*d*, and thereafter are collectively formed as a full-color image on the recording material by the secondary transfer using the secondary transfer roller 8.

Figure 2:
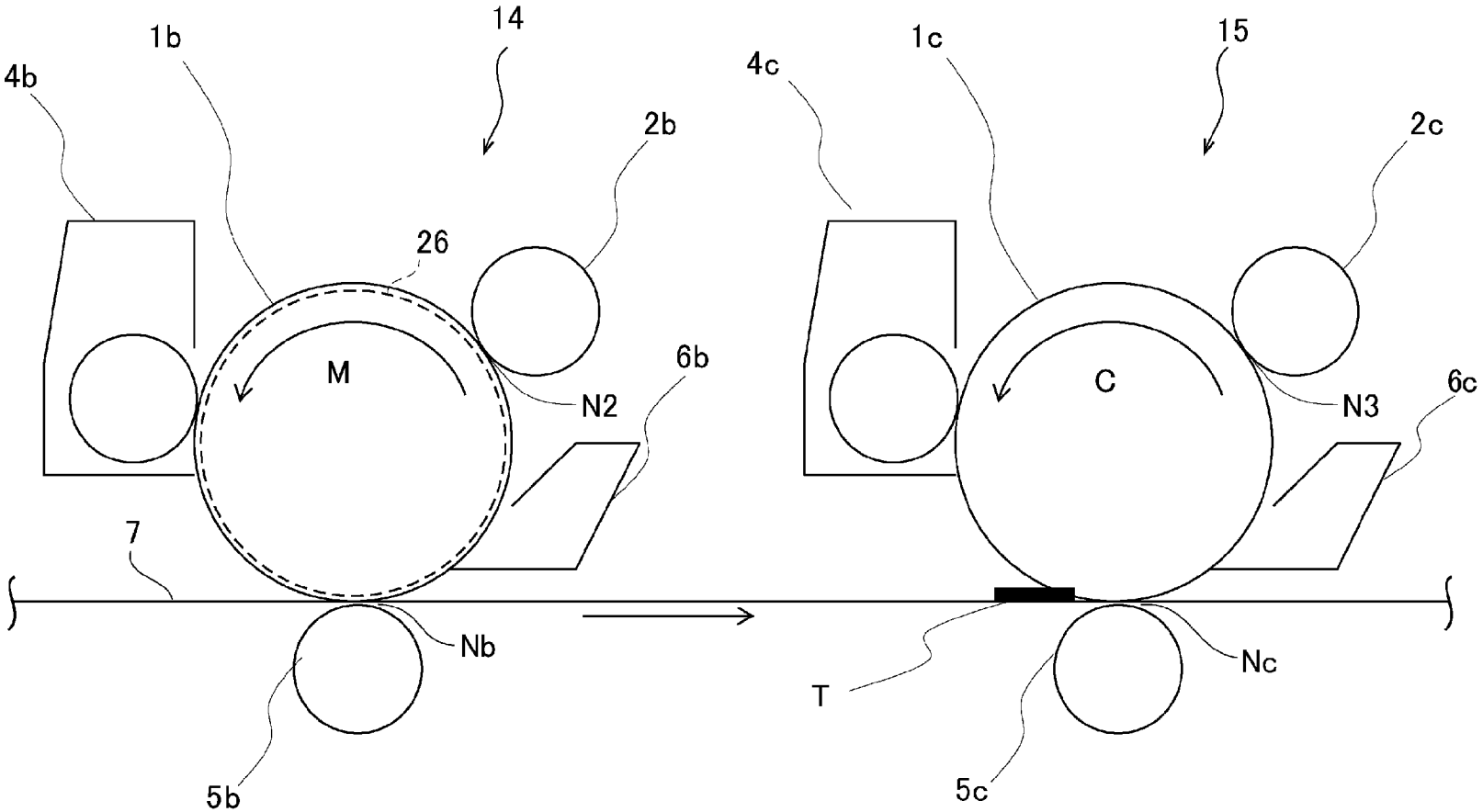
FIG. 2 is an enlarged schematic view illustrating production of a positive ghost image.

In this case, as shown in FIG. 2, the toner image T which is developed at, e.g., the image forming portion 14 as an upstream station and which is then transferred onto the intermediary transfer belt 7 at the transfer nip Nb by the primary transfer roller 5*b* is fed by the intermediary transfer belt 7. This toner image T passes through, e.g., the transfer nip Nc where the intermediary transfer belt 7 contacting the primary transfer roller 5*c* of the image forming portion 15 as a downstream station contacts the photosensitive drum 1*c*.

Figure 3:
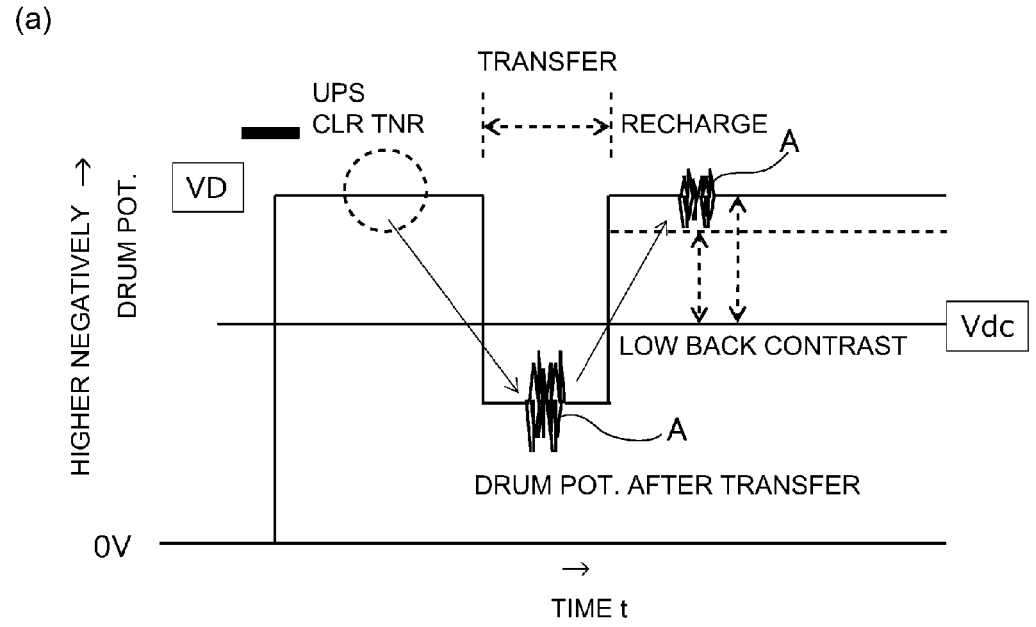
In FIG. 3, (*a*) is a graph showing the production of the positive ghost image, and (*b*) is a graph showing a transferring current vs. a photosensitive drum potential relating to the positive ghost image.
Figure 3:
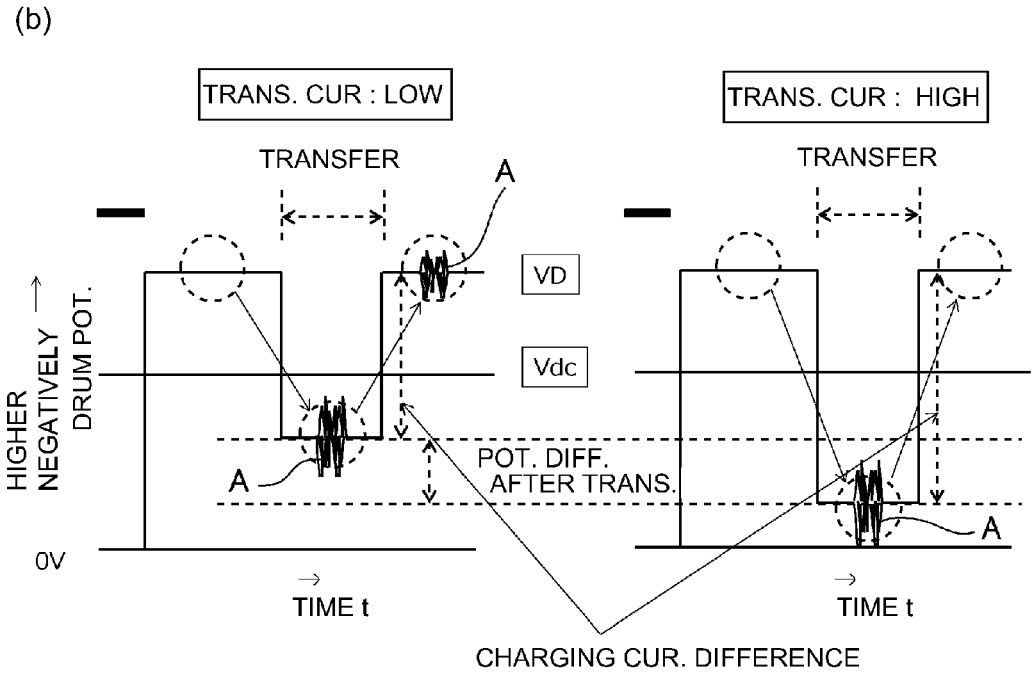

Here, (*a*) of FIG. 3 schematically illustrates a surface potential of the photosensitive drum (e.g., 1*c*) when the toner image T shown in FIG. 2 is positioned at the transfer nip (e.g., Nc).

In the image forming process of the reversal development type using the negative toner, the photosensitive drum (e.g., 1*c*) charged to the negative polarity at the transfer nip (e.g., Nc) receives a positive transfer bias, so that the negative potential at the surface thereof is lowered. Thereafter, when the photosensitive drum (e.g., 1*c*) is rotated and a surface region where the negative potential is lowered passes through the charging portion (e.g., the charging roller 2*c*) again, the photosensitive drum surface is electrically charged again to a VD potential (dark portion potential or charged potential) by, e.g., the charging roller 2.

In this case, when the toner image toner is present at the transfer nip (e.g., Nc) as described above, the potential of the photosensitive drum surface after passed through the transfer nip (e.g., Nc) where the toner image T is present causes minute potential non-uniformity A. This minute potential non-uniformity A is generated by an occurrence of electric discharge in a minute space between the deposited toner image T and the photosensitive drum (e.g., 1*c*) when the transfer bias is applied to the photosensitive drum via the toner image T.

The photosensitive drum surface subjected to such electric discharge causes the minute transfer nip A as shown in (a) of FIG. 3. The photosensitive drum portion where the minute potential non-uniformity A is generated is electrically charged again, but in the case where the potential non-uniformity A cannot be eliminated even when the photosensitive drum portion is electrically charged again, and the toner image T remains on the photosensitive drum portion, the following phenomenon occurs. That is, in subsequent image formation, in the case where the surface potential at the portion of the potential non-uniformity A is the VD potential (charge portion), a back contrast thereof with a developing bias VDC cannot be ensured sufficiently to cause a positive ghost image which is fog at a white background portion.

With respect to the positive ghost image, a gap between the intermediary transfer belt 7 and the photosensitive drum (e.g., 1*c*) is increased with an increasing amount of the toner passing through the transfer nip (e.g., Nc) to increase the potential non-uniformity due to the electric discharge, and therefore the amount of the fog toner becomes large to provide a thick (large) density, so that the positive ghost image is visualized.

With respect to the positive ghost image, a degree of this phenomenon is improved by increasing a transfer current to be supplied (applied), so that the positive ghost image disappears by sufficiently applying the transfer current. This was shown by an experiment of the present inventor.

The reason therefor is that by increasing the transfer bias applied to the photosensitive drum 1 to pass the transfer current in a large amount through the photosensitive drum 1, the charging current necessary to uniformly re-charge the photosensitive drum surface where the potential non-uniformity resulting in the positive ghost image is generated can be obtained. The charging current is a current generated in the case where the photosensitive drum surface is charged to the VD potential by output of a high voltage applied to the charging means such as the charging roller 2.

Part (b) of FIG. 3 schematically shows charge currents generated, depending on a magnitude of the transfer current, when the photosensitive drum 1 after the transfer is re-charged to the VD potential and shows a difference in elimination of the potential non-uniformity depending on the magnitude of the transfer current when the transfer nip portion of the photosensitive drum surface after the transfer is re-charged.

In (b) of FIG. 3, in the case where the transfer current by the primary transfer roller 5 is large, the surface potential at the transfer portion of the photosensitive drum 1 after the transfer is largely lowered toward 0 V compared with the case where the transfer current by the primary transfer roller 5 is low. In the case where the photosensitive drum surface is re-charged to the VD potential by the charging roller 2 as the charging means, the larger transfer current can provide a larger potential difference relative to the VD potential, and therefore a larger charging current is generated during the charging.

When this charging current is insufficient, the electric discharge enough to make the potential non-uniformity A uniform cannot be obtained at the time when the portion of the potential non-uniformity A is re-charged to the VD potential, so that the potential non-uniformity A cannot be eliminated. However, in the case where the potential difference between the charge potential and the photosensitive drum surface potential after the transfer is increased to ensure a sufficient charging current, the surface of the photosensitive drum 1 can be uniformly charged by sufficient electric discharge enough to make the non-uniformity A uniform. As a result, the occurrence of the positive ghost image caused due to partial decrease of the back contrast between the potential of the portion of the potential non-uniformity A and the developing bias VDC can be prevented effectively.

As described above, the positive ghost image is the phenomenon generated by the toner placed, as the fog, on a portion which is a white background portion originally. In this embodiment, by setting the transfer current (transfer bias) enough to prevent the occurrence of the positive ghost image, the difference in potential between the charge potential and the photosensitive drum surface potential after the transfer is increased to ensure the sufficient charging current, so that the occurrence of the positive ghost image is prevented.

However, a set value of the transfer current set as a countermeasure against the positive ghost image is set at a sufficiently high transfer current value in some cases so as not to generate the positive ghost image even when a generation condition of the positive ghost image fluctuates. In that case, compared with the case where a necessary minimum transfer current for preventing the occurrence of the positive ghost image is applied, corresponding to the current value se as the high value, it would be expected that the phenomenon called re-transfer further advances.

The re-transfer is such a phenomenon that electric charge of the toner of the toner image transferred onto the intermediary transfer belt 7 at the upstream station is reversed by the electric discharge at the secondary transfer nip of the transfer portion of the downstream station, and thus the toner of the upstream station is transferred back to the downstream photosensitive drum. When the re-transfer further advances, fluctuations in density and color (tint) of the image occur and are visualized as image defects on the recording material.

In order to eliminate the potential non-uniformity A causing the positive ghost image, there is a need to ensure a certain charging current amount or more. In this case, even in the case where the transfer current at the same level is applied, when the VD potential is different, the potential difference between the charge potential and the surface potential of the photosensitive drum 1 after the transfer is different, and therefore the amount of the charging current generated during the re-charging is changed. For that reason, a state of the occurrence of the positive ghost image is also fluctuated.

The photosensitive drum 1 is charged from the potential after the transfer to the VD potential again, but the amount of the charging current generated at this time is determined by the potential difference between the potential after the transfer and the VD potential (charge potential). In the case where the VD potential changed from the potential after the transfer by the re-charging is high, compared with the case where the re-charged VD potential is low, the potential difference between the potential after the transfer and the VD potential becomes large, and therefore the amount of the charging current generated during the charging becomes large, thus being advantageous in terms of the positive ghost image.

On the other hand, in the case where the re-charged VD potential is low, for a similar reason, even in the case where the same transfer current is applied, the case is disadvantageous in terms of the positive ghost image. In this way, even at the same transfer current, a difference in charging current is generated in the case where the VD potential is different, and therefore the occurrence of the positive ghost image is intended to be controlled by the transfer current, a difference in transfer current at which the positive ghost image occurs is generated.

By controlling the charging current by changing the VD potential, the state of the occurrence of the positive ghost image can be changed, but the VD potential should be determined for stabilizing the developing property and a degree of the fog depending on an environment of the main assembly of the image forming apparatus 12 and a degree of repetition of image formation (durability).

In the case where the VD potential is changed, the transfer current necessary to prevent the occurrence of the positive ghost image is changed. For that reason, in order to effectively prevent the occurrence of the positive ghost image by controlling the transfer current, there is a need to set a sufficient transfer current such that the transfer current at which the positive ghost image is not generated can be obtained even in the case where the fluctuation in charging current is generated by the change of the VD potential. The setting of such a sufficient transfer current generates a trade-off relationship (incompatible relationship) such that there-through further advances.

In general, toner deterioration advances with the repetition of the image formation, so that a charge retaining force of the toner itself is lowered and thus the toner charge amount is gradually lowered. In order to transfer the toner (image), there is a need to apply, during the transfer, the current depending on the toner charge amount, but in the case where the toner charge amount is low, also the transfer current necessary to transfer the toner image from the photosensitive drum onto the intermediary transfer belt 7 is lowered.

Further, with the toner deterioration, the amount of re-transfer of the toner is increased in the case where the same transfer current is applied. As a means for suppressing such an increase in re-transfer amount with the toner deterioration, it is effective that the transfer current set during the image formation is decreased from an initial value in accordance with the repetition of the image formation (durability).

Figure 4:
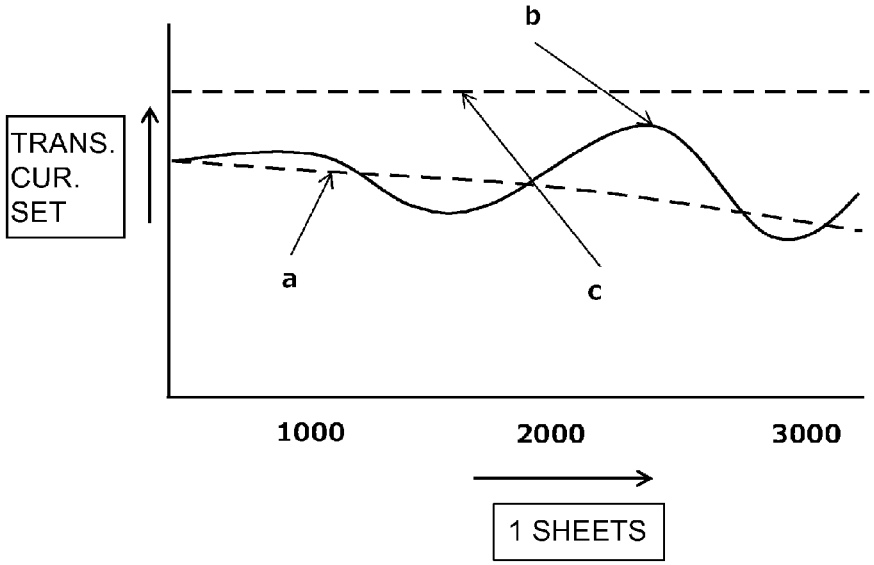
In FIG. 4, (*a*) is a graph showing a relationship between the number of image formations and the transferring current, and (*b*) is a graph showing a relationship between a transfer voltage and a detected current property in a PTVC control system.
Figure 4:
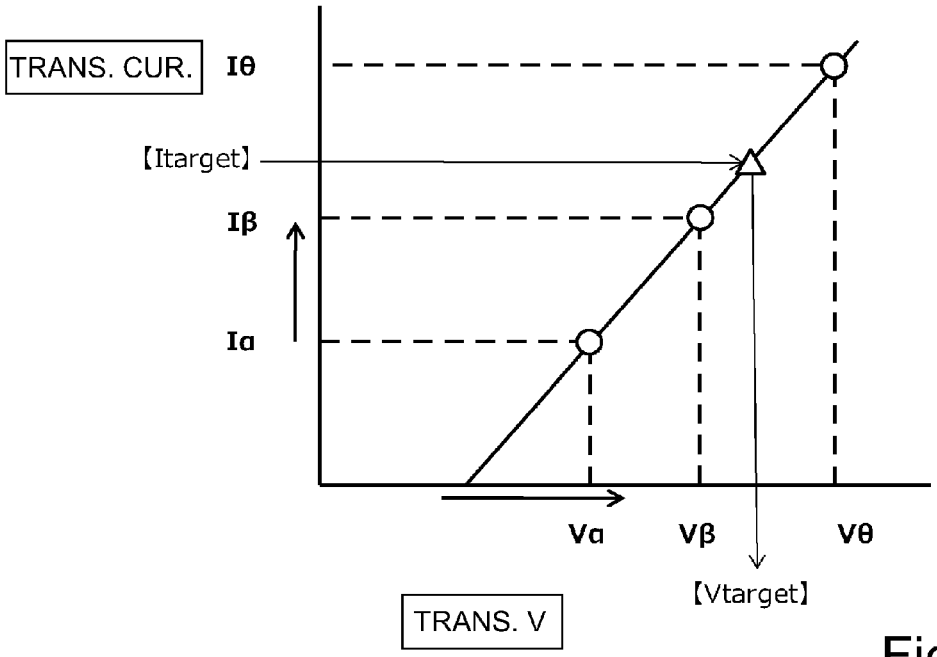

Part (a) of FIG. 4 is a schematic graph, as an example, in the case where the transfer current is controlled throughout the repetition of the image formation. That is, (a) of FIG. 4 shows progression of the transfer current when the setting of the transfer current throughout the repetition of the image formation is controlled as in the cases of (a), (b) and (c) below. These cases of (a), (b) and (c) correspond to lines a, b and c indicated in the figure.

(a) The transfer current is set to be lowered depending on the repetition of the image formation.

(b) The transfer current is set to ensure the charging current necessary to prevent the positive ghost image.

(c) A sufficient transfer current capable of preventing the positive ghost image even when the VD potential is changed is set.

According to the case of (a), in the setting in which the transfer current is lowered depending on the repetition of the image formation, with the lowering in toner charge amount, also the transfer current necessary to transfer the toner is lowered, so that the applied transfer current is lowered also in order to suppress the increase in re-transfer amount due to the toner deterioration. As a result, it becomes possible to suppress the increases in re-transfer amount due to the toner deterioration.

However, the positive ghost image is liable to occur in the image forming apparatus employing the constitution of the DC charging type and the pre-exposure-less type, and therefore when the transfer current is lowered as in the setting of the above case of (a), it would be considered that the charging current is insufficient and thus the positive ghost image occurs.

According to the above case of (b), in the case where the transfer current is set to ensure the charging current necessary to prevent the positive ghost image, the occurrence of the positive ghost image can be prevented. However, the transfer current suitable for the toner charge amount necessary to transfer the toner from the photosensitive drum onto the intermediary transfer belt 7 cannot be obtained in some cases, and therefore there is a fear that an inconvenience such as improper transfer occurs.

According to the above case of (c), in the case where the sufficient transfer current capable of preventing the positive ghost image even when the VD potential is changed is set, the re-transfer amount of the toner is increased correspondingly to the current set at the high level.

In this way, for the purpose of decreasing the cost, according to the device constitution employing the DC charging type and the pre-exposure-less type, the positive ghost image is liable to occur. In the case where the charging current amount for preventing the occurrence of the positive ghost image cannot be controlled, in order to obtain the charging current at which the positive ghost image is not generated even when an operation (use) environment of the image forming apparatus 12 is changed, the sufficient transfer current must be controlled by the setting of the case of (c).

In view of these factors, in this embodiment, by (transfer bias setting sequence) and (flow for determining transfer bias during image formation) which are described later, the occurrence of the positive ghost image is prevented to eliminate the improper transfer, so that the transfer current for suppressing the re-transfer amount to a minimum is supplied.

[DC Charging Type]

In the DC charging type, when the potential of the photosensitive member such as the photosensitive drum is charged to −700 V, as the DC voltage, there is a need to apply a discharge start voltage in addition to the charge potential. There is a need to apply a voltage of −700 V+(−) discharge start voltage Vth. In this embodiment, Vth is −600 V, and therefore, the applied voltage is −1300 V.

As described above, as a feature of the DC charging type, the discharge start voltage Vth varies depending on a shape and contamination of the charging roller 2, and therefore it is known that potential uniformity in a plane of the photosensitive member is inferior to that in the AC/DC charging type and thus image uniformity is inferior to that in the AC/DC charging type. On the other hand, there is no electric discharge in an amount corresponding to an AC component, and therefore a degree of deterioration of the photosensitive member is small and a lifetime against the drum abrasion can be extended compared with the AC/DC charging type. Further, there is no need to separately provide the AC power source and therefore the DC charging type has an advantage such that a cost of the device itself can be reduced. However, the DC charging type has no potential uniformizing effect of the AC voltage obtained when the DC voltage is superposed with the AC voltage, and therefore convergence of the charge potential is better in the AC charging type, so that also power for causing the potential non-uniformity leading to the positive ghost image to disappear is excellent in the AC charging type. The DC charging type is disadvantageous in terms of the positive ghost image compared with the AC/DC charging type for the reason described above.

[Pre-exposure-less Type]

The image forming apparatus 12 is not provided, in an upstream-side of the charging process means, with a pre-exposure means for light-removing a residual electric charge of the photosensitive drum surface after the toner image transfer, and therefore the device constitution is simplified, so that the image forming apparatus 12 is effective in reducing the cost but is disadvantageous in terms of positive memory compared with the case where the pre-exposure means is provided.

[PTVC Control Type]

In order to transfer the toner images from the photosensitive drums onto the intermediary transfer belt 7 by the primary transfer rollers 5*a*-5*d*, respectively, the transfer current passing through the transfer nips (transfer portions) Na, Nb, Nc and Nd is measured by applying the voltage in advance of the image formation, so that a voltage condition used during the transfer is set. To the photosensitive drum 1 on which the toner image passes, constant voltages (a plurality of different transfer biases) of a plurality of levels are applied via the primary transfer roller 5, and then a value of the current passing through the primary transfer roller 5 at each of the levels is measured. From voltage-current characteristics of a plurality of levels, an output voltage corresponding to a transfer current (target transfer current Itarget) necessary to transfer the toner image during the image formation is subjected to interpolation computation. Based on a result of the interpolation computation, the constant voltage used during the image formation is set.

Part (b) of FIG. 4 is a graph schematically showing a transfer voltage-detected current characteristic in a PTVC control type in this case. To the primary transfer roller 5 through which the toner image does not pass, transfer voltages Vα, Vβ and Vθ of a plurality of different potential levels are applied, and then transfer currents Iα, Iβ and Iθ passing at that time are detected by a transfer current detecting portion 22. Then, from the voltage-current characteristic, the output voltage corresponding to the transfer current value (Itarget) necessary to transfer the toner image during the image formation is subjected to the interpolation computation, so that a transfer voltage (Vtarget) corresponding to the transfer current (Itarget) is obtained.

At this time, as the target transfer current used during the image formation, the transfer current (Itarget) necessary to transfer the toner image is, on the basis of detection of a temperature and humidity sensor 20 (FIG. 1) in the image forming apparatus, set in accordance with a transfer current value table set depending on a humidity as shown in FIG. 5. The set transfer current (Itarget) is stored in a memory 28 of the controller 17.

In the control of the image forming apparatus 12 in this embodiment, a condition and a frequency of execution of the PTVC control type are such that the control is executed during (subsequent) image formation after an integrated number of sheets from execution of the last transfer bias setting sequence reaches 1000 sheets during first image formation after turning-on of the power source.

In this detection, the transfer current can be controlled at high accuracy by increasing the frequency of the execution, but downtime is increased. Therefore, there is a need to set an optimum frequency of the execution in consideration of necessary accuracy and downtime.

[Transfer Bias Setting Sequence]

Next, the transfer bias setting sequence as the control in this embodiment will be described. By this control, it is possible to obtain a transfer current (Itarget DOJI) corresponding to a charging current (PItarget: preset charging current) necessary to prevent the positive ghost image.

Figure 6:
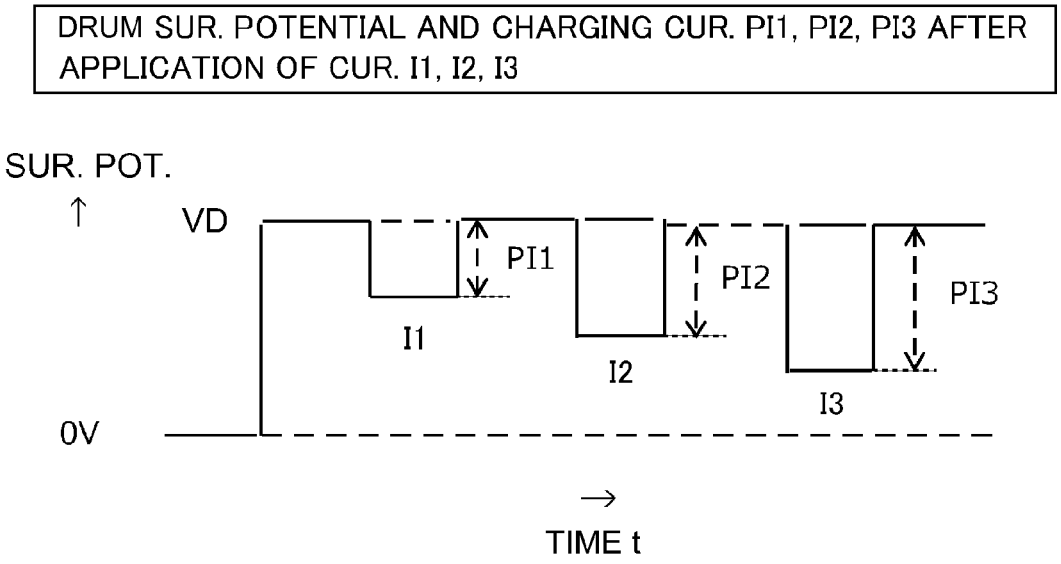
FIG. 6 is a timing chart showing a relationship between a transfer bias setting sequence and a surface potential of the photosensitive drum according to the first embodiment.
Figure 10:
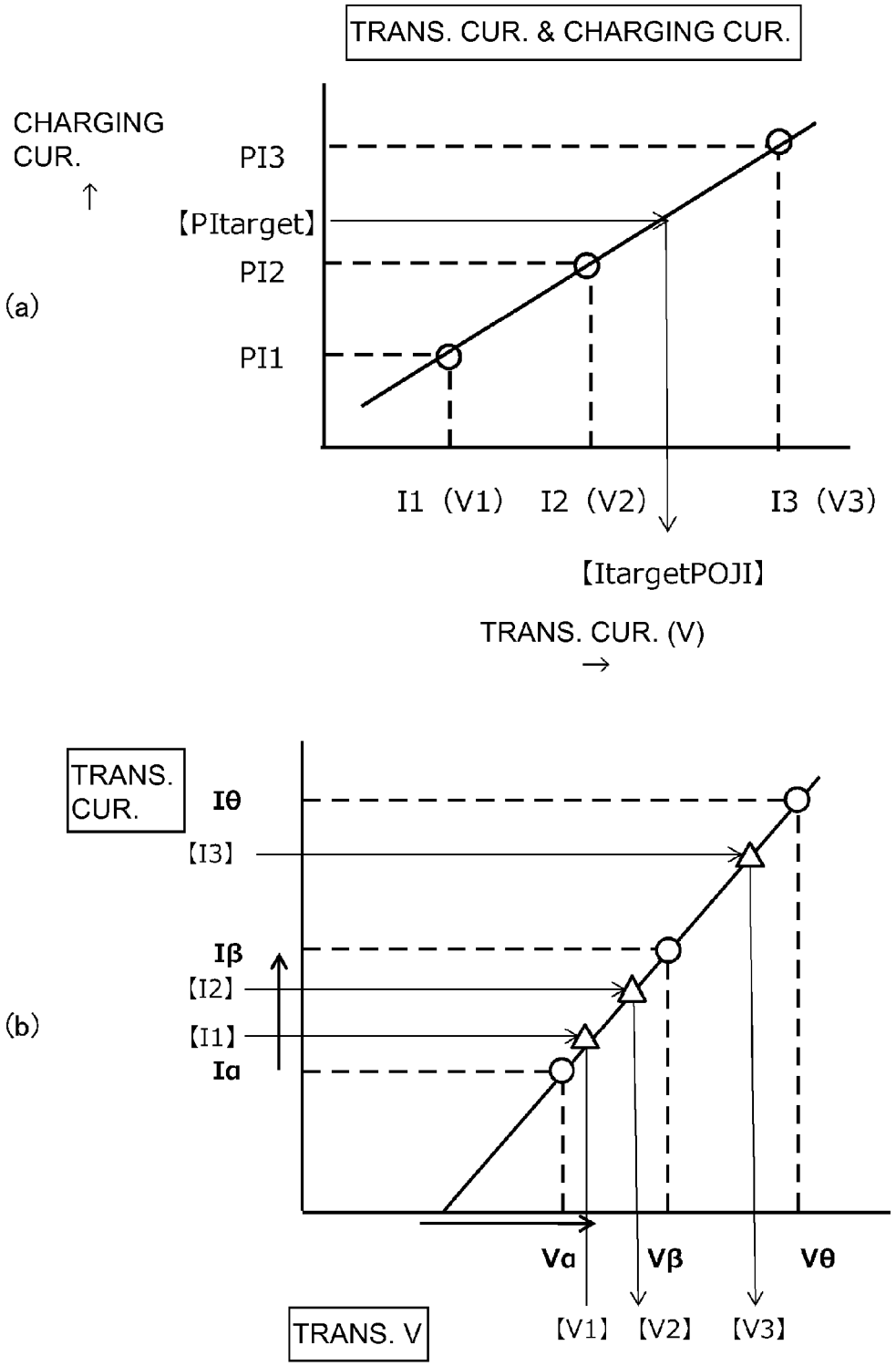
In FIG. 10, (*a*) shows a relation between a transferring current and a charging current at the transfer bias setting sequence according to the first and second embodiments, and (*b*) shows transferring currents I1-I3 and voltages V1-V3 corresponding thereto used in the PTVC control system and the transfer bias setting sequence, according to the first and second embodiments.

Next, with reference to FIG. 6 and (a) and (b) of FIG. 10, details of an operation of the transfer bias setting sequence will be described in order. Incidentally, FIG. 6 is a schematic view showing a state of a surface potential and a charging current of the photosensitive drum 1 during the transfer bias setting sequence in this embodiment. Part (a) of FIG. 10 is a graph showing a relationship between the transfer current (voltage) and the charging current generated under application of the transfer current in the transfer bias setting sequence. Part (b) of FIG. 10 is a graph showing a transfer voltage detect current characteristic in the transfer bias setting sequence, transfer currents I1, I2 and I3 of a plurality of levels and corresponding voltages V1, V2 and V3.

(A) The photosensitive drum 1 is charged to the VD potential.

(B) On the basis of the voltage current characteristic at the transfer portion in the PTVC control type, the transfer voltage V1 corresponding to the transfer current Il for measuring the charging current is applied.

(C) The potential of the photosensitive drum 1 after the transfer by (B) is re charged.

(D) A charging current value PI1 generated during (C) is detected.

(E) Also the transfer voltages V2 and V3 corresponding to the transfer currents I2 and I3 applied for measuring the charging current on the basis of the voltage current characteristic at the transfer portion in the PTVC control type are similarly subjected to (A) to (D), so that generated charging currents PI2 and PI3 are detected.

(F) A film thickness of the charge transporting layer (CT layer) 26 of the photosensitive drum 1 is calculated by the thickness calculating portion 21. Then, in accordance with the table, the transfer current (Itarget POJI) corresponding to the charging current (PItarget), necessary to prevent the positive ghost image, depending on the film thickness is obtained from the relationship of the detected values I1, I2 and I3 with PI1, PI2 and PI3.

In this embodiment, specific set values were such that the VD potential was −700 V, the transfer currents I1, I2 and I3 for measuring the charging current were 10 μA, 20 μA and 30 μA, respectively, and the transfer voltages V1, V2 and V3 corresponding to the transfer currents I1, I2 and I3 were 200 V, 450 V and 800 V, respectively.

The transfer currents I1, I2 and I3 for measuring the charging current are not limited to the values in this embodiment, but may also be set at transfer current values in a range used during actual image formation on the basis of the voltage-current characteristic, so that a similar effect can be obtained.

That is, in a period in which the toner images do not pass through the transfer nips Na-Nd, the controller 17 applies, to the primary transfer rollers 5*a*-5*d*, the plurality of different transfer biases (Vα, Vβ, Vθ) when a region where the photosensitive drum 1 is charged to a predetermined potential passes through the transfer nips Na-Nd. The controller 17 is capable of executing the transfer bias setting sequence set, on the basis of the relationship of the transfer biases (Vα, Vβ and Vθ) with the charging currents (Iα, Iβ and Iθ), the transfer biases (I1, I2 and I3) corresponding to the charging currents (PItarget) for preventing the positive ghost image. The charging currents (Iα, Iβ and Iθ) are detected by the charging current detecting portion 18 when the above-described region of the photosensitive drum 1 passes through the transfer nips Na-Nd at the time of application of the transfer biases (Vα, Vβ and Vθ) subsequently passes through the charging nips N1-N4.

The controller 17 compares the transfer biases set by the detection result of the temperature and humidity sensor 20, on the basis of a relationship between the transfer current (Itarget POJI: i.e., the transfer bias set in the sequence) and values of a preset humidity and the transfer bias. Then, a larger transfer bias is used as a transfer bias to be applied during the image formation (step S3 in FIG. 7). Further, the controller 17 sets, on the basis of a preset relationship between the film thickness of the CT layer 26 and the charging current, the charging current (PItarget: preset charging current) necessary to prevent the positive ghost image from the film thickness calculated by the thickness calculating portion (thickness calculating means) 21.

Figure 11:
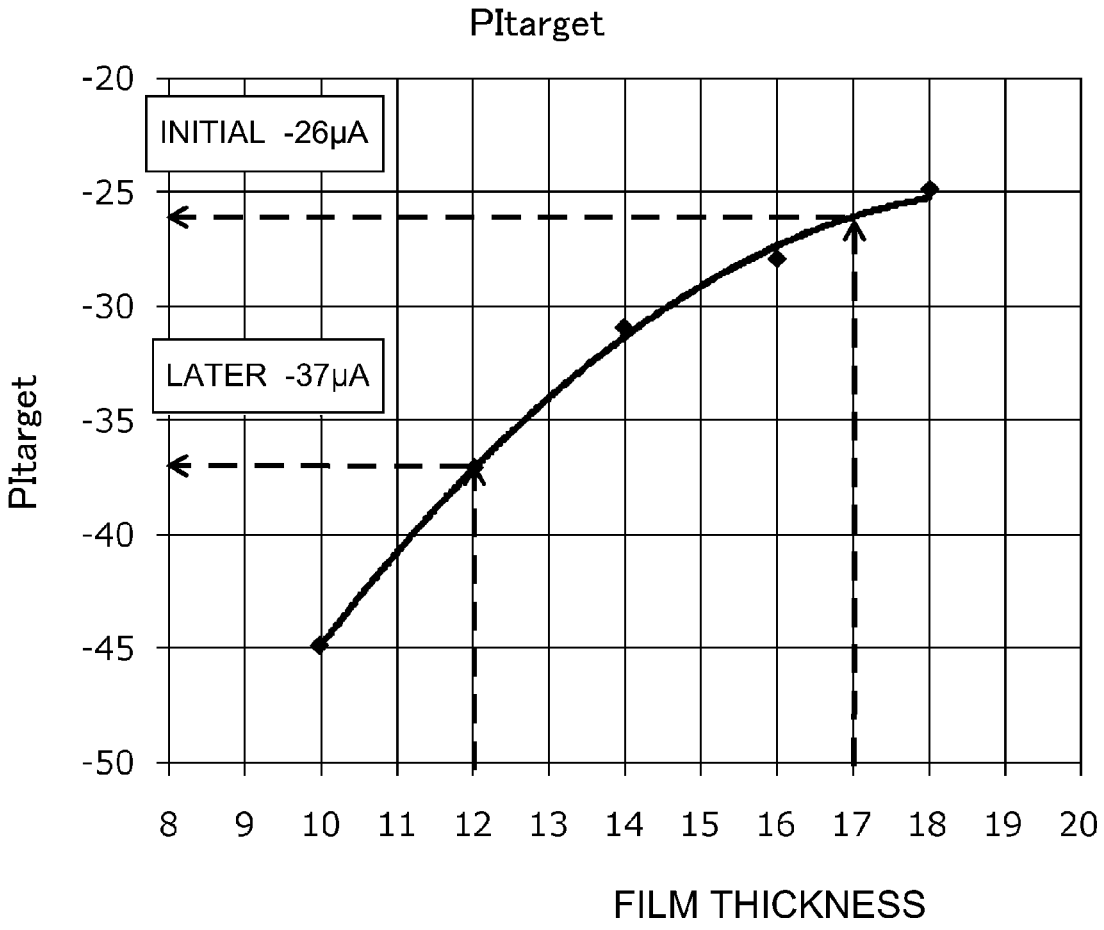
FIG. 11 shows a relationship between a CT film thickness and a charging current required for positive ghost image prevention according to the first and second embodiments.

The charging current (PItarget) necessary to prevent the positive ghost image is set, depending on the film thickness of the corresponding to layer 26, based on, e.g., values of a table shown in FIG. 11. Incidentally, FIG. 11 is a graph showing a relationship between the film thickness of the CT layer 26 and the charging current (PItarget) necessary to prevent the positive ghost image in this embodiment.

The CT layer 26 of the photosensitive drum 1 is abraded by the repetition of the image formation to increase the capacity of the photosensitive drum 1, so that a current amount of the charging current (PItarget) necessary to prevent the positive ghost image is gradually increased. For that reason, by a separate experiment, the charging current (PItarget) necessary to prevent the positive ghost image is obtained depending on the thickness of the CT layer and is set as shown in FIG. 11.

The controller 17 calculates, on the basis of a driving time of the drum 1 in the charged state, the film thickness of the CT layer 26 by using the thickness calculating portion 21, thus calculating an abrasion amount of the CT layer 26.

In the control of the image forming apparatus 12 in this embodiment, the execution condition and frequency of the transfer bias setting sequence are the same as those in the PTVC control type. That is, the condition and the frequency of execution of the transfer bias setting sequence are such that the transfer bias setting sequence is capable of being executed during (subsequent) image formation after an integrated number of sheets from execution of the last transfer bias setting sequence reaches 1000 sheets during first image formation after turning-on of the power source.

[Process for Determining Transfer Bias During Image Formation]

Figure 7:
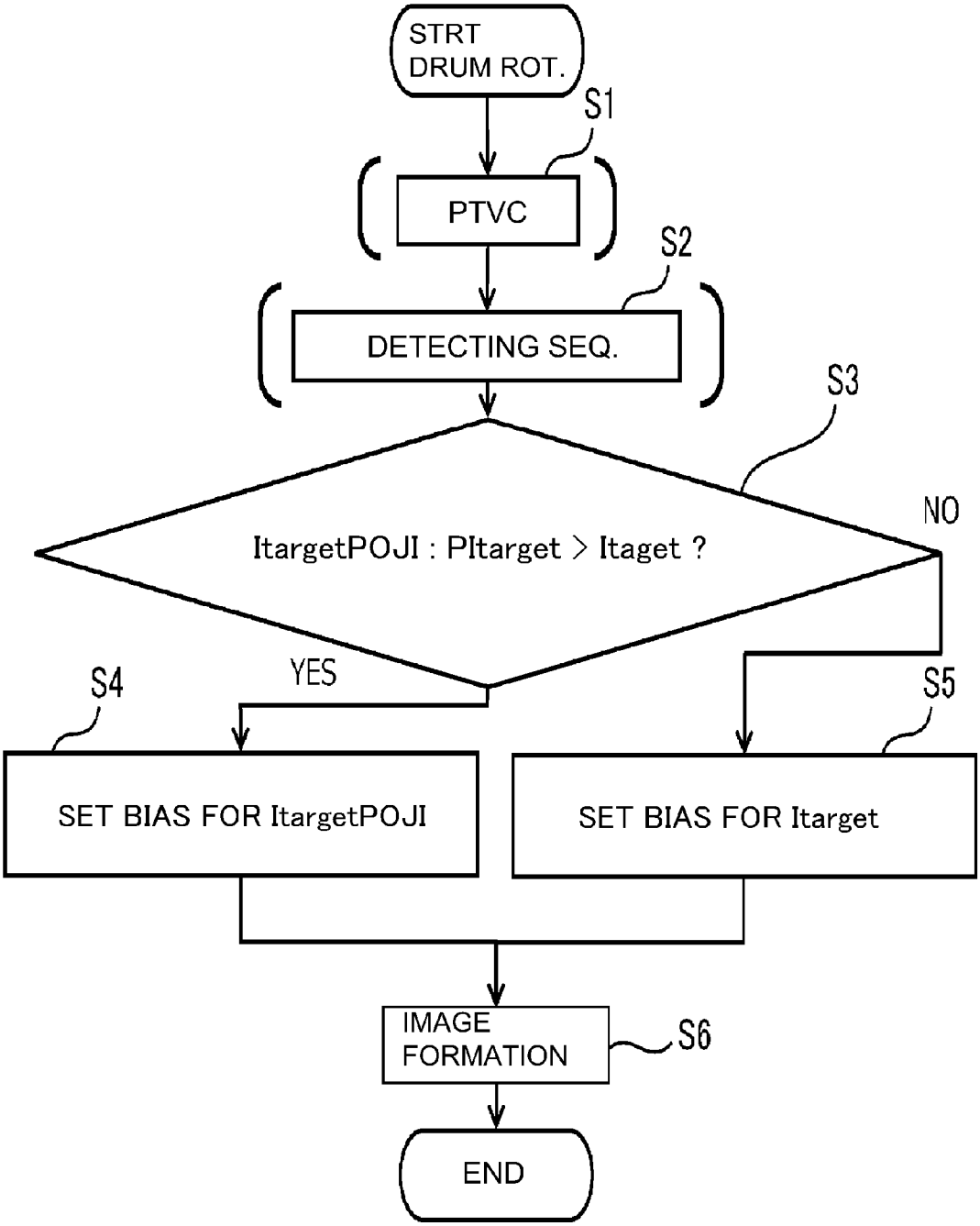
FIG. 7 is a flow chart showing a process of determining a transfer bias in the image forming operation according to the first embodiment.

Next, a process when the transfer bias during the image formation is determined by the PTVC control type and the transfer bias setting sequence will be described with reference to a flow chart of FIG. 7. Incidentally, in the figure, the PTVC control type and the case where the charging current control execution condition and the condition during the image formation are coinciding with each other are shown in parentheses.

The controller 17 executes the PTVC control type (step S1) and the charging current detecting sequence as the transfer bias setting sequence (step S2), and on the basis of obtained results, determines the transfer bias during the image formation. In the case where the conditions do not coincide with each other, the control using values until the last determination is executed.

The controller 17 obtains, after a rotation operation of the drum 1 is started, the voltage current characteristic at the transfer portion in the PTVC control type and the transfer current (Itarget), necessary to transfer the toner image, as the target transfer current corresponding to a relative humidity detected by the temperature and humidity sensor 20.

Thereafter, by the charging current detecting sequence as the transfer bias setting sequence described above, the charging current (PItarget) necessary to prevent the positive ghost image is obtained from the table to obtain the transfer current (Itarget POJI) corresponding to the charging current (PItarget).

In step S3, the controller 17 compares the necessary transfer current (Itarget) with the corresponding transfer current (Itarget POJI), and uses, as a transfer bias to be applied during image formation, the transfer bias corresponding to a larger transfer current value (steps S4 and S5).

As a result, with respect to each of the transfer current (Itarget) necessary to transfer the toner image and the transfer current (Itarget POJI) necessary to prevent the positive ghost image, a short of the transfer current can be eliminated to prevent the improper transfer and the occurrence of the positive ghost image. Further, a necessary minimum transfer current depending on that time can be supplied, and therefore the re transfer amount is prevented from being increased more than necessary.

In this embodiment described above, the charging current detecting sequence as the transfer bias setting sequence is performed while employing the DC charging type and the pre-exposure-less type for the purpose of reducing the cost, so that the transfer bias to be applied during the image formation is properly set and thus the occurrence of the positive ghost image can be prevented. That is, as the preset charging current, by using the charging current for preventing the occurrence of the positive ghost image, it is possible to prevent the occurrence of the positive ghost image with reliability. As a result, it is possible to supply the transfer current capable of suppressing the re-transfer amount to a minimum level without causing the improper transfer, so that it is possible to effect the image formation causing no other harmful effects such as an abnormal image.

<Second Embodiment>

Next, an image forming apparatus 12 according to Second Embodiment to which the present invention is applied will be described. A constitution in this embodiment is similar to that of the image forming apparatus 12 in First Embodiment.

In this embodiment, a process of exposing the surfaces of the photosensitive drums 1*a*-1*d* to light by the exposure devices 3*a*-3*d*, respectively is performed between the execution of the PTVC control type and the execution of the transfer bias setting sequence which are described in First Embodiment.

That is, the image forming apparatus 12 in this embodiment does not cancel a residual potential on the photosensitive drum surface after the image formation due to the pre exposure less type. In the case where the residual potential during the last image formation remains on the photosensitive drum surface, by the influence of the residual potential, there is a possibility that the accuracy of the transfer bias setting sequence is impaired. Therefore, in this embodiment, the residual potential is canceled by the exposure using the exposure devices 3*a* 3*d* to use the photosensitive drums on which the surface potential is made smooth (made uniform), so that the transfer bias setting sequence is executed in a state in which the accuracy thereof is enhanced.

Figure 8:
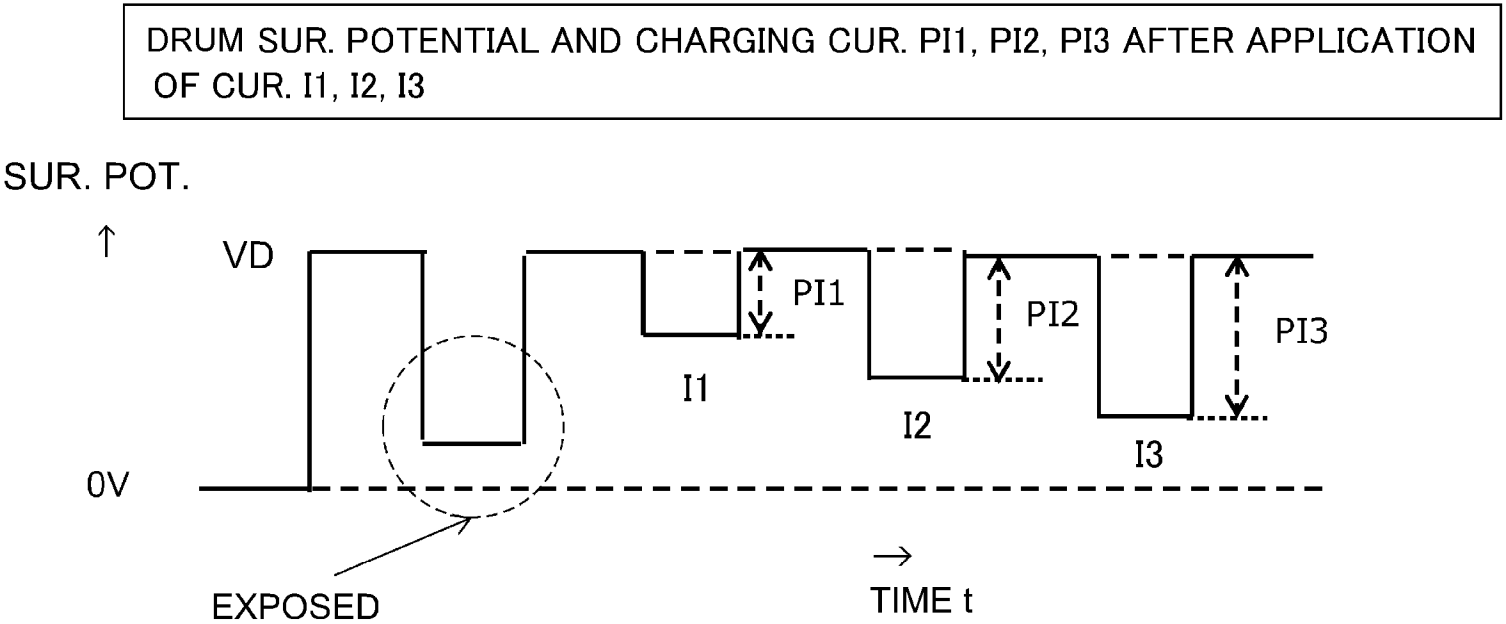
FIG. 8 is a timing chart showing a relationship between a transfer bias setting sequence and a surface potential of the photosensitive drum according to the second embodiment.

Here, with reference to FIG. 8, details of an operation of the transfer bias setting sequence will be described. Incidentally, FIG. 8 is a schematic view showing a state of a surface potential and a charging current of the photosensitive drum 1 during the transfer bias setting sequence in this embodiment.

(I) The photosensitive drum 1 is charged to the VD potential.

(II) The photosensitive drums 1*a* 1*d* are exposed to light by the exposure devices 3*a* 3*d*.

(III) On the basis of the voltage current characteristic at the transfer portion in the PTVC control type, the transfer voltage V1 corresponding to the transfer current I1 for measuring the charging current is applied.

(IV) The potential of the photosensitive drum 1 after the transfer by (III) is re charged.

(V) A charging current value PI1 generated during (IV) is detected.

(VI) Also the transfer voltages V2 and V3 corresponding to the transfer currents I2 and I3 applied for measuring the charging current on the basis of the voltage current characteristic at the transfer portion in the PTVC control type are similarly subjected to (I) to (V), so that generated charging currents PI2 and PI3 are detected.

(VII) A film thickness of the charge transporting layer (CT layer) 26 of the photosensitive drum 1 is calculated by the thickness calculating portion 21, and then, by the table, the transfer current (Itarget POJI) corresponding to the charging current (PItarget), necessary to prevent the positive ghost image, depending on the film thickness is obtained from the relationship of the detected values I1, I2 and I3 with PI1, PI2 and PI3.

The exposure in (II) by the exposure devices 2*a*-3*d* is exposure for a whole surface solid image. In this embodiment, specific set values were such that the VD potential was −700 V, the transfer currents I1, I2 and I3 for measuring the charging current were 10 μA, 20 μA and 30 μA, respectively, and the transfer voltages V1, V2 and V3 corresponding to the transfer currents I1, I2 and I3 were 200 V, 450 V and 800 V, respectively.

Further, in this embodiment, similarly as in First Embodiment, the transfer currents I1, I2 and I3 for measuring the charging current are not limited to the values in this embodiment, but may also be set at transfer current values in a range used during actual image formation, so that a similar effect can be obtained.

[Process for Determining Transfer Bias During Image Formation]

Figure 9:
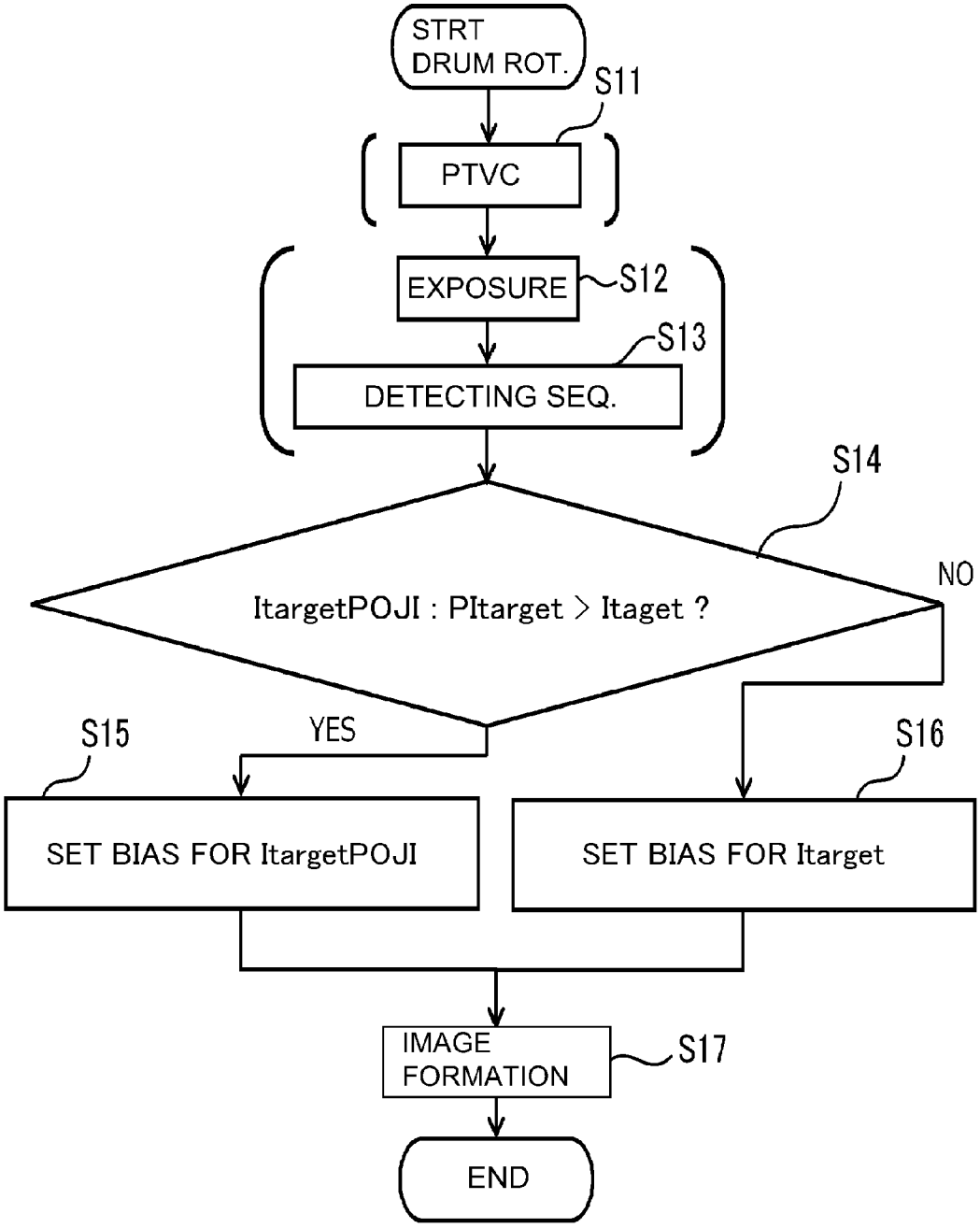
FIG. 9 is a flow chart showing the process of determining the transfer bias in the image forming operation according the second embodiment.

A process for determining the transfer bias during the image formation by the PTVC control type and the transfer bias setting sequence in this embodiment will be described with reference to a flow chart of FIG. 9.

Basic operations (S11 and S13-S17) are similar to those in the process in First Embodiment.

In this embodiment, in addition to the basic operations (S1-S6) in First Embodiment, the photosensitive drum surfaces exposed to light by the exposure devices 3*a*-3*d* in step S12 are subjected to the charging current detecting sequence as the transfer bias setting sequence.

In this embodiment, in place of the pre-exposure by the pre-exposure device, the whole surface exposure of the photosensitive drums 1*a*-1*d* by the exposure devices 3*a*-3*d* is performed. That is, in this embodiment, the exposure device (exposure means) 3 for forming the electrostatic latent image (latent image) by exposing, to light, the surface of the photosensitive drum 1 charged by the charging roller (charging means) 2 and the developing device (developing means) 4 for developing the electrostatic latent image formed on the photosensitive drum 1 by the exposure device 3 are provided. Further, in a region which is downstream of the primary transfer roller (transfer means) 5 and which is upstream of the charging roller (charging means) 2 with respect to the rotational direction of the photosensitive drum 1, the drum cleaning device (cleaning means) 6 for cleaning the surface of the photosensitive drum (image bearing member) 1 is provided.

That is, the image forming apparatus 12 in this embodiment does not include the pre-exposure device. This point is the same as that in First Embodiment, but in this embodiment (Second Embodiment), the controller 17 uses the exposure device 3 to uniformly expose the surface of the photosensitive drum 1 to light, thus placing the photosensitive drum surface in a state as if the photosensitive drum surface is subjected to the pre-exposure, so that it is possible to perform the transfer bias setting sequence.

For this reason, the surface of the photosensitive drum 1 is exposed to light so as not to be influenced by the residual potential to be placed in a stable drum potential state, and in this state, the transfer bias setting sequence can be executed, so that the accuracy of the control can be enhanced. As a result, a necessary minimum transfer current depending on that time can be supplied, and therefore the re-transfer amount is prevented from being increased more than necessary.

According to this embodiment, in the image forming apparatus 12 employing the DC charging type and the pre-exposure-less type for the purpose of reducing the cost, by the charging current setting sequence, the transfer bias to be applied during the image formation can be properly set. As a result, the occurrence of the positive ghost image is prevented to obviate the improper transfer, so that it is possible to supply the transfer current capable of suppressing the re-transfer amount to a minimum level.

In the present invention, the transfer bias set in the transfer bias setting sequence on the basis of the relationship of the plurality of the transfer biases with the detected charging currents while using the DC charging type and the pre-exposure-less type in order to realize the cost reduction can be used as, e.g., the transfer bias for preventing the occurrence of the positive ghost image. As a result, it becomes possible to prevent the occurrence of the positive ghost image and thus image formation in which other harmful effects such as the abnormal image are not generated can be effected.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 020442/2013 filed Feb. 5, 2013, which is hereby incorporated by reference.

What is claimed is:

1. An image forming apparatus comprising:

a movable image bearing member;

a charging member configured to charge said image bearing member at a charge portion;

a detecting member configured to detect a current flowing through said charging member;

a toner image forming unit configured to form a toner image on said image bearing member;

a transfer member configured to transfer, at a transfer portion, a toner image formed on said image bearing member onto a transfer medium;

a transferring voltage source configured to apply a voltage to said transfer member; and a controller configured to execute a setting mode for setting a voltage to be applied to said transfer member at the time when the toner image is transferred onto the transfer medium, so that a predetermined current flows through said charging member when such an area of said image bearing member as has carried the toner image transferred onto the transfer medium at the transfer portion then passes through the charge portion, the setting mode being executed on the basis of a current detected by said detecting member when such an area of said image bearing member as has been charged by said charging member and has been passed through the transfer portion in a state that a test voltage is applied to said transfer member then passes through the charge portion in a period in which no toner image passes through the transfer portion.

2. An image forming apparatus according to claim 1, wherein said detecting member is defined as a first detecting member, and the image forming apparatus further comprises a second detecting member configured to detect a current flowing through said transfer member, wherein a plurality of different test voltages are applied to said transfer member and a plurality of currents flowing through said transfer member are detected respectively by said second detecting member in the setting mode, said controller sets the voltage to be applied to said transfer member on the basis of currents detected by said first detecting member at times when such areas of said image bearing member as have passed through the transfer portion in the state that the test voltages are applied to said transfer member then pass through the charge portion, respectively.

3. An image forming apparatus according to claim 1, wherein said image bearing member includes a photosensitive member, and said toner image forming unit includes an image exposing unit configured to form an electrostatic latent image by exposing said photosensitive member on the basis of an image signal after charging said photosensitive member by said charging member.

4. An image forming apparatus according to claim 3, further comprising a discriminating portion for discriminating a thickness of said photosensitive member, wherein the predetermined current is set in accordance with a result of said discriminating portion.

5. An image forming apparatus according to claim 3, wherein said charging member is supplied with a DC voltage when said image bearing member is charged.

6. An image forming apparatus according to claim 3, wherein the area having carried the toner image transferred onto the transfer medium at the transfer portion is then charged at the charge portion without being exposed to light.

7. An image forming apparatus comprising:

a movable photosensitive member;

a charging member configured to charge said photosensitive member at a charge portion;

a detecting member configured to detect a current flowing through said charging member;

a first toner image forming unit configured to form a first toner image on said photosensitive member;

an intermediate transfer member configured to receive, at a transfer portion, a first toner image formed on and transferred from said photosensitive member;

a transfer member configured to receive a voltage;

a second toner image forming unit, disposed upstream of the transfer portion with respect to a moving direction of said intermediate transfer member, configured to form a second toner image to be transferred on said intermediate transfer member; and a controller configured to execute a setting mode for setting a voltage to be applied to said transfer member at the time of no toner image passing through the transfer portion, so that a predetermined current flows through said charging member at the time of the first toner image being transferred onto said intermediate transfer member, on a basis of a detection result of said detecting member when such an area of said photosensitive member as has been charged by said charging member and has been passed through the transfer portion in a state of a test voltage being applied to said transfer member then passes through the charge portion.

8. An image forming apparatus according to claim 7, wherein said detecting member is defined as a first detecting member, and said image forming apparatus further comprises a second detecting member configured to detect a current flowing through said transfer member, wherein a plurality of different test voltages are applied to said transfer member and a plurality of currents flowing through said transfer member are detected respectively by said second detecting member in the setting mode, said controller sets the voltage to be applied to said transfer member on the basis of currents detected by said first detecting member at times when such areas of said photosensitive member as have passed through the transfer portion in the state that the test voltages are applied to said transfer member then pass through the charge portion, respectively.

* * * * *